US006808092B2

(12) United States Patent
Timbrook

(10) Patent No.: US 6,808,092 B2
(45) Date of Patent: Oct. 26, 2004

(54) HOPPER BOX

(75) Inventor: Ronald D. Timbrook, Edgerton, OH (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/337,709

(22) Filed: Jan. 6, 2003

(65) Prior Publication Data

US 2004/0129739 A1 Jul. 8, 2004

(51) Int. Cl.[7] ..... B65D 5/72

(52) U.S. Cl. ..... 222/460; 222/559; 222/564; 229/122.2; 229/6

(58) Field of Search ..... 229/122.2; 222/460, 222/559, 561, 564, 184

(56) References Cited

U.S. PATENT DOCUMENTS 2,894,666 A * 7/1959 Campbell, Jr. ..... 229/122.2
3,785,534 A * 1/1974 Smith ..... 229/122.2
3,799,409 A * 3/1974 Goerke ..... 222/561
4,119,263 A * 10/1978 Cuthbertson et al. .... 229/122.2
4,120,420 A * 10/1978 Dirksing ..... 229/122.2
4,342,405 A * 8/1982 Croley ..... 222/564
4,397,406 A * 8/1983 Croley ..... 229/122.2

* cited by examiner

*Primary Examiner*—Kenneth Bomberg

(57) ABSTRACT

The present invention includes a blank and a container constructed from containerboard material cut and scored to form an inner and an outer housing. The outer housing includes opposing side and end walls that are hingedly attached to a plurality of bottom panels that form a container bottom. The bottom panels include a hopper bore defined therethrough. An inner housing includes an interior upper region and an interior lower region. At least a portion of the interior upper region is substantially rigidly attached to an inner surface of the outer housing. The interior lower region is configured to form a plurality of inwardly angled interior panels that are angled substantially in the direction of the hopper bore. A removable closure panel is configured to close or otherwise substantially selectively seal the hopper bore.

6 Claims, 6 Drawing Sheets

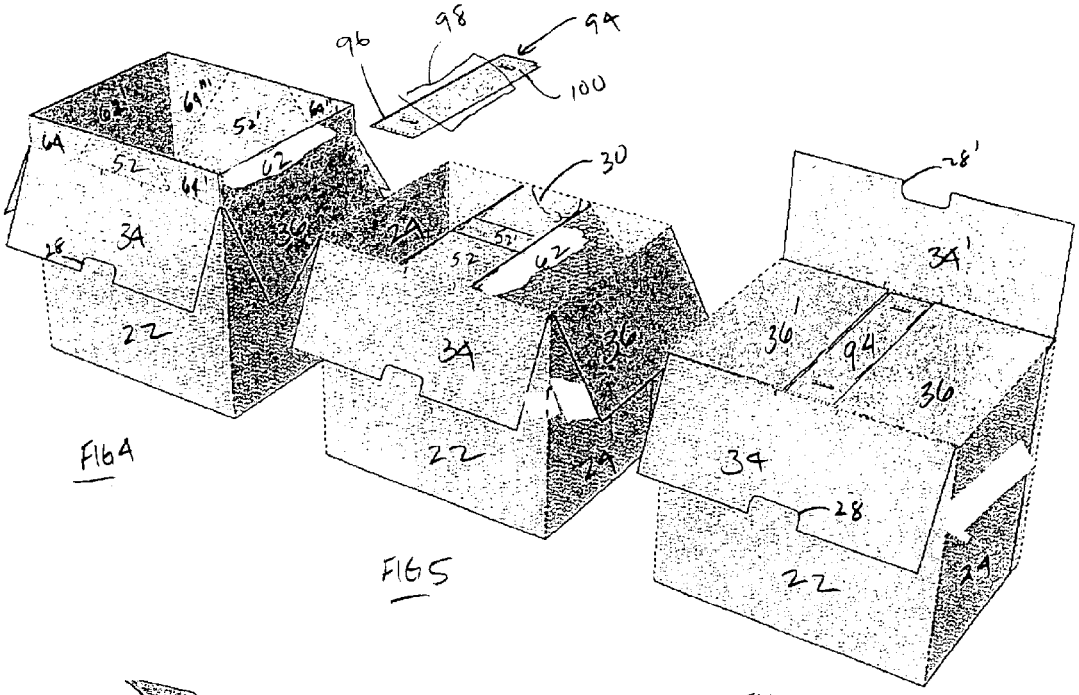
FIG 4
FIG 5
FIG 6
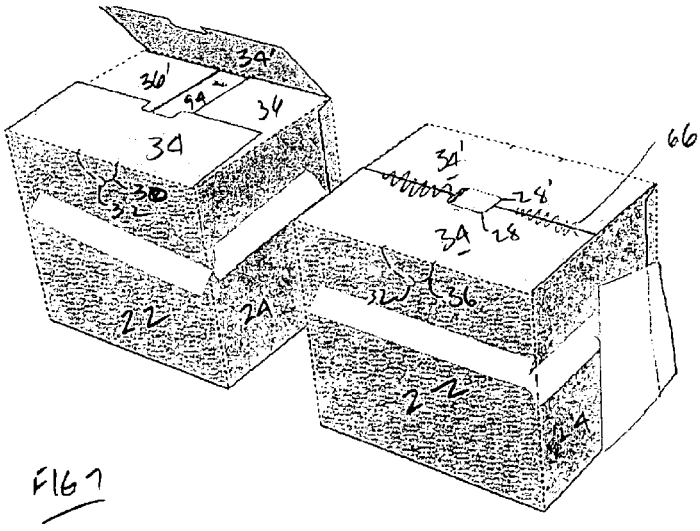
FIG 7
FIG 8

HOPPER BOX

FIELD OF THE INVENTION

This invention relates generally to containers and, more specifically to bulk bin type containers.

BACKGROUND OF THE INVENTION

Bulk bin containers are commonly used to store any variety of products. Typically, due to the relatively large size of the container and need for stability, the containers are designed with relatively large flat bottoms and are designed to be loaded and unloaded through the top of the container. The current container designs have inherent limitations.

The current flat bottom designs create a container with an interior profile similar to the outside profile. Thus, the interior shape of the container includes a relatively large flat bottom. Also, as most bin containers are not cylindrical, rather octagonal, rectangular or square, there are corner regions that can inhibit removal of the product. Consequently, when products are removed from container, extra time and care is required to remove all of the goods from the container. Additionally, the top unloading design requires the container to be turned upside down to remove all the products, which is a potential safety hazard.

SUMMARY OF THE INVENTION

The present invention includes a blank and a container constructed from containerboard material cut and scored to form an inner and an outer housing. The outer housing includes opposing side and end walls that are hingedly attached to a plurality of bottom panels that form a container bottom. The bottom panels include a hopper bore defined therethrough. An inner housing includes an interior upper region and an interior lower region. At least a portion of the interior upper region is substantially rigidly attached to an inner surface of the outer housing. The interior lower region is configured to form a plurality of inwardly angled interior panels that are angled substantially in the direction of the hopper bore. A removable closure panel is configured to close or otherwise substantially selectively seal the hopper bore.

BRIEF DESCRIPTION OF THE DRAWINGS

The preferred and alternative embodiments of the present invention are described in detail below with reference to the following drawings.

FIG. 4 is a perspective view of a container being formed in accordance with the present invention;

FIG. 5 is a perspective view of a container being formed in accordance with the present invention;

FIG. 6 is a perspective view of a container being formed in accordance with the present invention;

FIG. 7 is a perspective view of a container being formed in accordance with the present invention;

FIG. 8 is a perspective view of a container formed in accordance with the present invention;

DETAILED DESCRIPTION OF THE INVENTION

Figure 1:
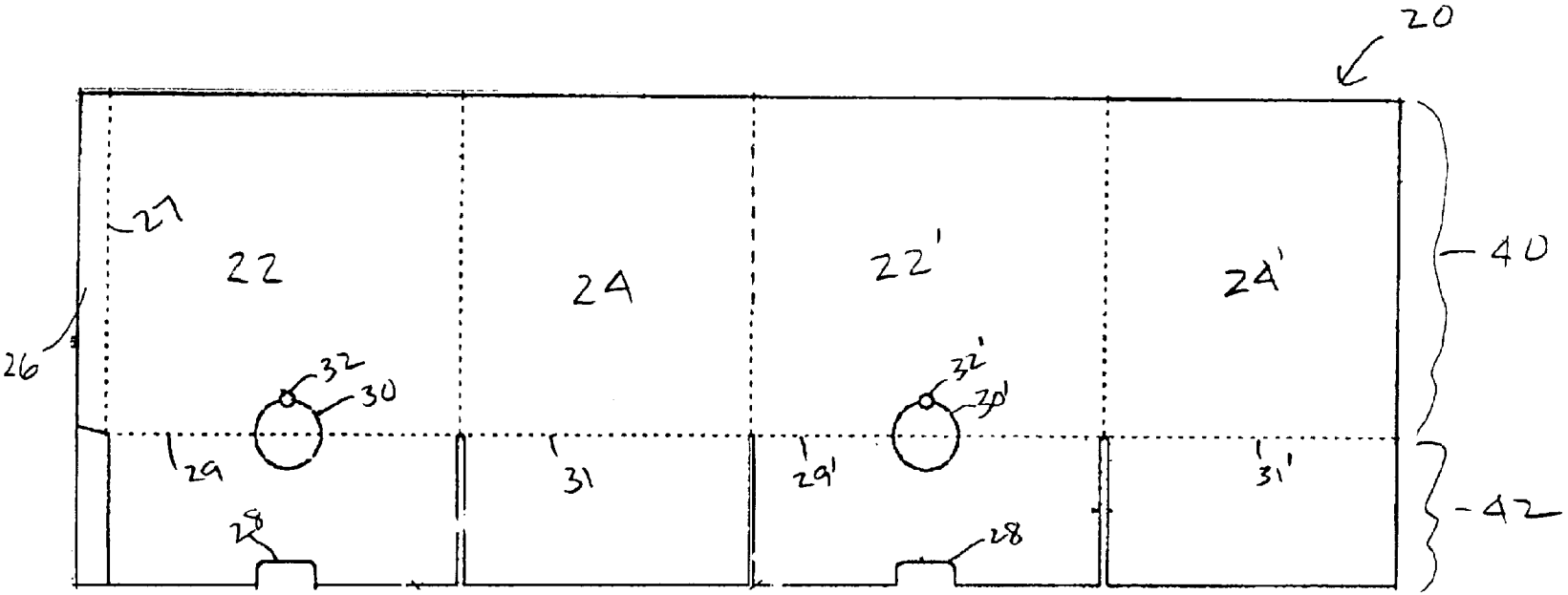
FIG. 1 is a plan view of a container blank outer housing formed in accordance with the present invention.

The present invention includes blanks cut and scored to form a container configured for top loading and bottom unloading. By way of overview and with reference to FIGS. 1–13, one presently preferred embodiment of the present invention includes an outer blank 20 arranged to form a container outer housing. An inner blank 50 is configured to substantially rigidly attach to an inner surface of the outer blank 20 and is also configured to form an angled inner wall arrangement. The angled inner wall arrangement angles a lower portion of the container's interior in a direction substantially in the direction of a hopper bore 28 defined through the bottom of the container. A closure panel 94 is configured provide a removable closure panel 94 to selectively cover and substantially seal the hopper bore 28.

The various blanks 20, 50 are cut, scored, perforated or otherwise formed to include a plurality of panels which, when assembled, create the container 90 of the present invention. More specifically, in all FIGURES, like numbers indicate like parts. Additionally, cuts are shown as solid lines, score lines as dashed lines and lines of perforations as broken lines.

In a presently preferred embodiment the blanks 20, 50, and subsequent container 90 are constructed of a containerboard material. In a particular embodiment, the blanks 20, 50 are constructed from a triple wall containerboard material. However, any other containerboard material is considered within the scope of this invention. Further, a paperboard material is also within the scope of this invention. Still further, the blanks 20, and 50 may be constructed of different material. For example, without limitation, blank 20 may be constructed of a triple wall containerboard material, while blank 50 is constructed of a single or double wall containerboard material, or vice versa.

FIG. 1 depicts an outer container blank 20 that forms the outer housing 76 of the container 90. In a presently preferred embodiment, the outer housing 76, when erected into a container 90 is generally rectangular in shape. As will be appreciated by those skilled in the art, the outer housing 76 may take any general geometric shape, such as, without limitation, a square. In a rectangular shaped container 90, side panels 22, 22', form the longitudinal sides of the outer housing 20, the side panels 22, 22' are separated by, and hingedly connected to end panels 24, 24' along hinge lines 23, 23', the combination of which form the walls of the container 90. Additionally, an outer joint panel 26 is hingedly attached one of the side panels 22, 22' to facilitate securing of the various end and wall panels upon erection of the container 90.

The bottom region 42 of the outer container blank 20 includes various panels hingedly attached to the various panels that form the walls of the outer container blank 20. More specifically, bottom side flaps 34, 34' are hingedly attached to the side panels 22, 22' along hinge line 29, 29', and bottom end flaps 36, 36' are likewise hingedly attached to end panels 24, 24' along hinge line 31, 31'. The overall shape of the bottom side flaps 34, 34' and the bottom end flaps 36, 36' will be dependent upon the overall geometry of the container 90. However, the presently preferred embodiment, the bottom side flaps 34, 34' and the bottom end flaps 36, 36' are generally rectangular in shape.

A hopper bore 28, 28' is defined through various panels that make up to bottom region. In the presently preferred embodiment, the hopper bore 28, 28' is formed in an edge of the bottom side flaps 34, 34' opposite the edge hingedly attached to the side panels 22, 22'. Further, those skilled in the art will appreciate the hopper bore 28, 28' being formed in any of the panels making up the bottom region 42. Additionally, the hopper bore 28, 28' may be formed entirely within a single panel of the bottom region 42 (not shown).

Figure 12:
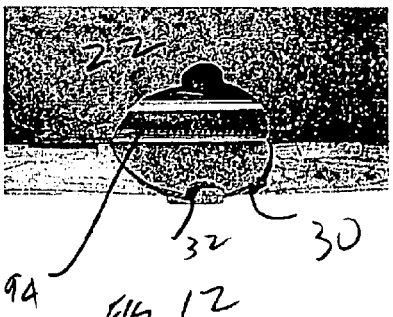
FIG. 12 is an isolated perspective view of the access panel region in accordance with the present invention.
Figure 13:
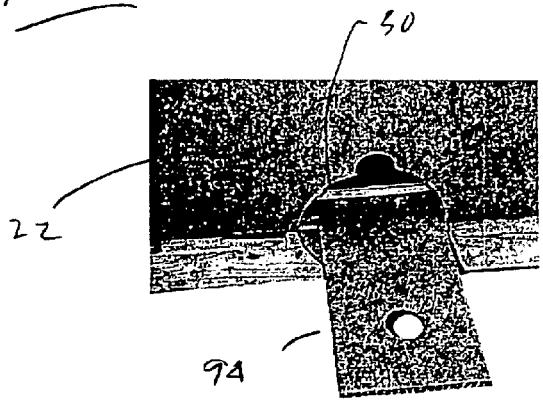
FIG. 13 is another isolated perspective view of the access panel region in accordance with the present invention.

Referring now to FIGS. 1, 12 and 13, an access panel 30 is cut into both the side panels 22, 22' and bottom side flaps 34, 34'. The access panel 30 is configured to provide user access into an interior of the outer housing of the container and to provide sliding access for the closure panel 94. Consequently, the overall size of the access panel is generally dictated by size of the closure panel 94. As depicted in the FIGURES, the access panel 30 is circular in shape. However, an access panel 30 of any shape, such as, without limitation, a square or rectangle is considered within the scope of this invention. An optional finger hold 32 may be included.

Figure 2:
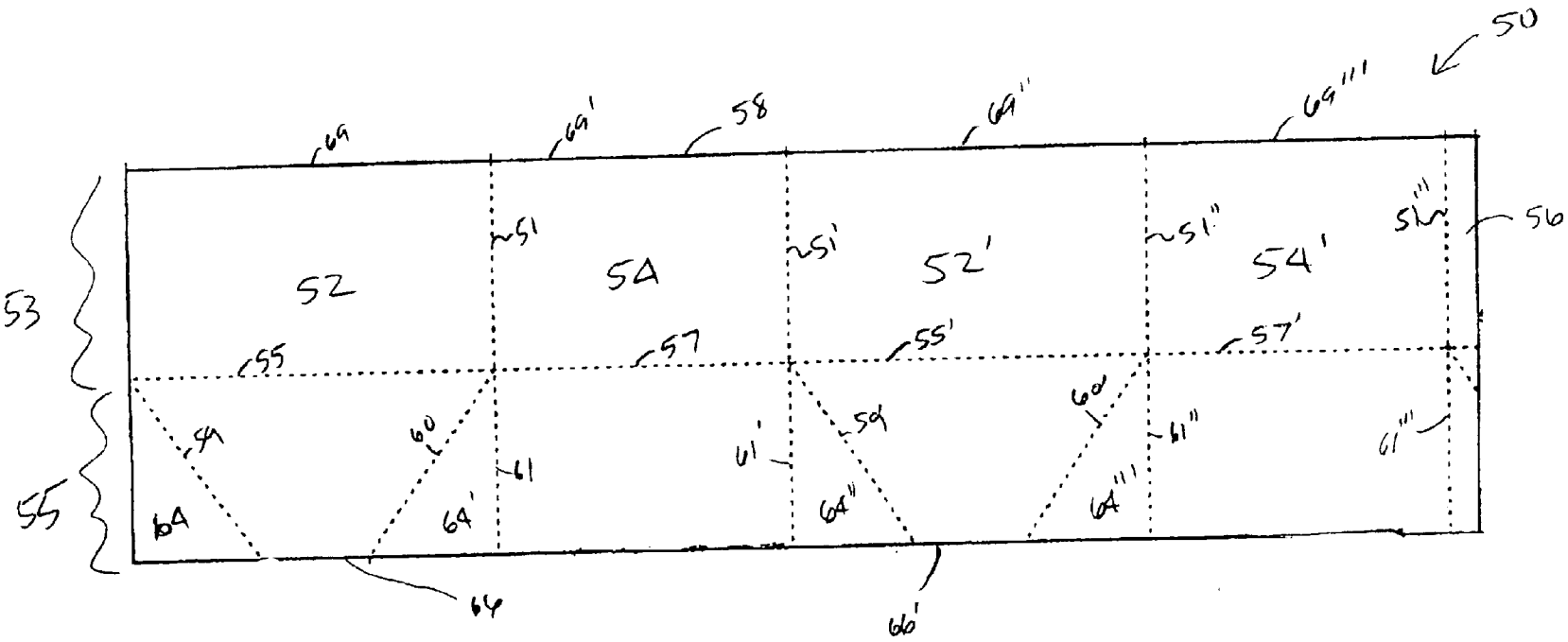
FIG. 2 is a plan view of a container blank inner housing formed in accordance with the present invention.

FIG. 2 depicts an inner container blank 50 that forms the inwardly angled interior panels of the container 90. Similar to the outer container blank 20, the inner container blank 50 includes an interior upper region 53 and an interior lower region 55. The interior upper region 53 includes hopper side panels 52, 52' which are separated by and hingedly connected to hopper end panels 54, 54' at hinge lines 51, 51'. The hopper side panels 52, 52' are preferably similar in shape to, albeit slightly smaller, than side panels 22, 22'. Likewise, the hopper end panels 62, 62' are equally similar in shape to the end panels 24, 24'. Further, an inner joint panel 56 is hingedly connected to a hopper end panel 54, 54' and is configured to help maintain the container's structural integrity once the container 90 is formed.

The interior lower region 55 of the inner container blank 50 includes angled hopper side panels 60, 60' hingedly attached to the hopper side panels 52, 52' along hinge lines 55, 55'. Similarly, angled hopper end panels 62, 62 are hingedly attached to hopper end panels 54, 54' along hinge lines 57, 57'. Hinge panels 64, 64', 64", 64'" are hingedly connected to and intermediate of angled hopper side panels 60, 60 and the angled hopper end panels 62, 62' along hinge lines 59, 59', 59", 59'" and 61, 61', 61", 61'", respectively.

The interior upper region 53 of the inner container blank 50 is substantially rigidly attached to an inner surface of the outer container blank 20. In a presently preferred embodiment, the inner container blank 50 is laminated to the outer container blank 20. However, any known method of joining the inner container blank to the outer container blank 20 is considered to be within the scope of this invention. For example, glues or any other adhesive materials may be used to join the two blanks. Likewise, mechanical fasteners such as staples, brads or clips may be used, alone or in conjunction with glue or other adhesives.

Figure 3:
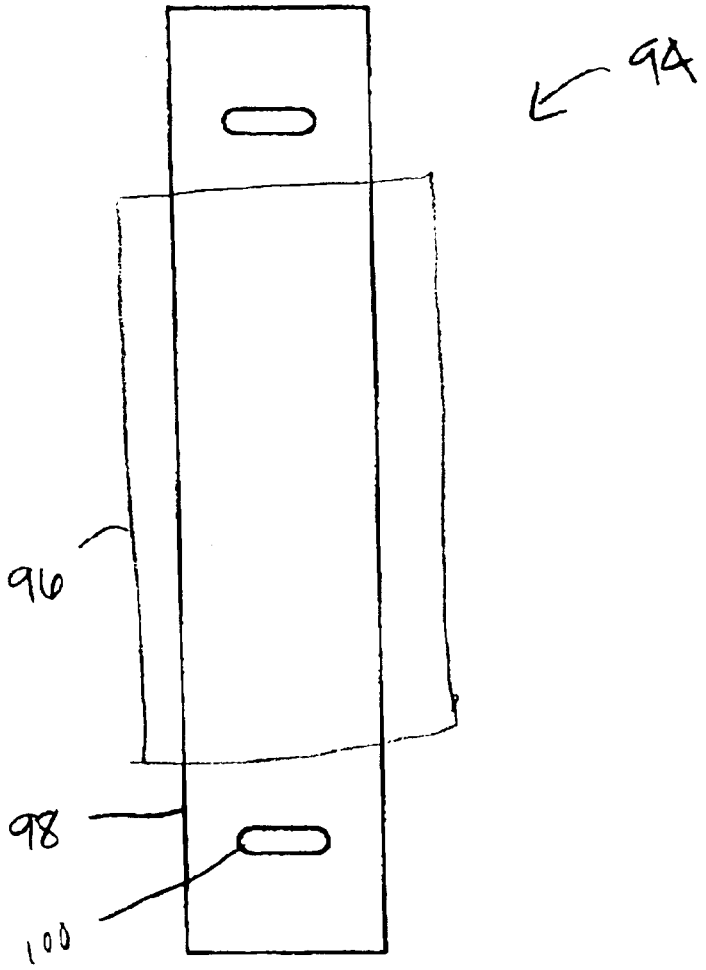
FIG. 3 is a plan view of a container blank closure panel formed in accordance with the present invention.
Figure 9:
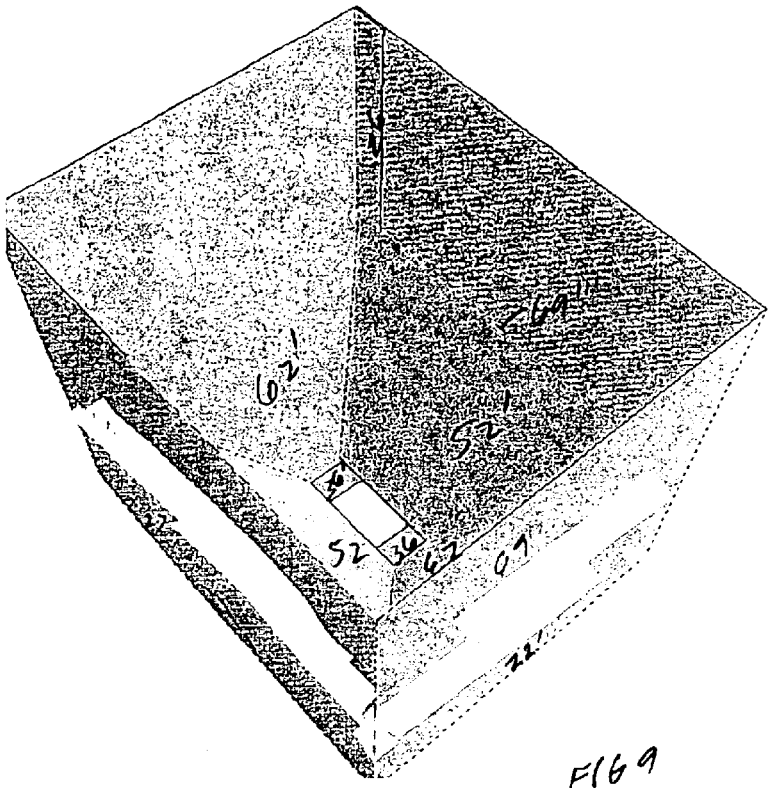
FIG. 9 is a perspective view of a container being formed in accordance with the present invention.

FIGS. 3, 12 and 13 depict various aspects of the closure panel 94. The closure panel 94 is configured to fit between the ends of the bottom end flaps 36, 36 when the container 90 is closed (see FIG. 6). As such, the closure panel 94 is preferably just slightly shorter in length than the internal width of the container 90. An optional flange 96 may be incorporated with the closure panel to improve sealing of the hopper bore 28, 28.

The closure panel 94 is configured to be selectively removable from the container 90 by sliding out of the opening defined by the access panel 30. The closure panel 94 may be completely removed from the container 90 or partially removed to control the flow rate of product through the hopper bore 28, 28. Once the container 90 is empty, or a desired amount of product has been removed from the container 90, the closure panel 94 may be slid back into position to close the hopper bore 28, 28 and prevent the passage of product therethrough. In this manner, the container 90 may be reused any number of times.

FIGS. 4–11 depict the container 90 in various stages of formation. In particular, FIGS. 4–8 illustrate the formation of the container 90 as viewed with the container 90 upside down. Initially, the container 90 is formed by attaching the outer joint panel 26 and inner joint panel in a manner commonly known in the art. The resulting arrangement is depicted in FIG. 4. As can be seen, the inner container blank 50 extends a distance above the outer container blank 20. This distance is variable and dependent upon the overall box design, shape and size.

With reference to FIG. 5, the inner container blank 50 is manipulated to form the shape of the angled interior panel arrangement. To form the angled interior panel arrangement, inwardly directed pressure is applied to either of the opposed inner hopper side panels 52, 52' or hopper end panels 54, 54', or both. The applied pressure causes the angled hopper side panels 60, 60' and the angled hopper end panels 62, 62' to form the funnel-shape angled interior panels best depicted in FIG. 9. As those skilled in the art will appreciate, the overall shape of the hopper bin is depended upon the general shape of the container 90. For example, a square container would have angled interior panels with substantially identically shaped angled wall panels.

To help maintain the shape of the hopper bin, a binder 58 may be applied to the angled hopper end panels 62, 62. Any known binder is within the scope of this invention, such as, without limitation, tape or other adhesive strips. Once the hopper bin is properly formed, the bottom end flaps 36, 36 can be closed.

As best seen in FIGS. 6–8, the closure panel 94 is inserted between the edges of the bottom end flaps 36, 36. Subsequently, the bottom side flaps 34, 34 are closed and the container 90 is optionally held closed with tape 66, such as box or strapping tape. Likewise, any tape or similar substance may be used to close off the bottom portion of the container.

Figure 10:
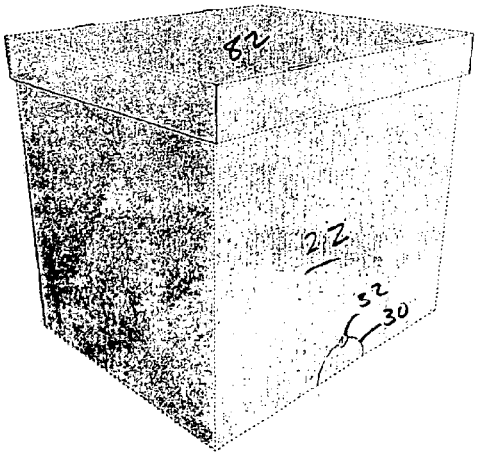
FIG. 10 is a perspective view of a container formed in accordance with the present invention.
Figure 11:
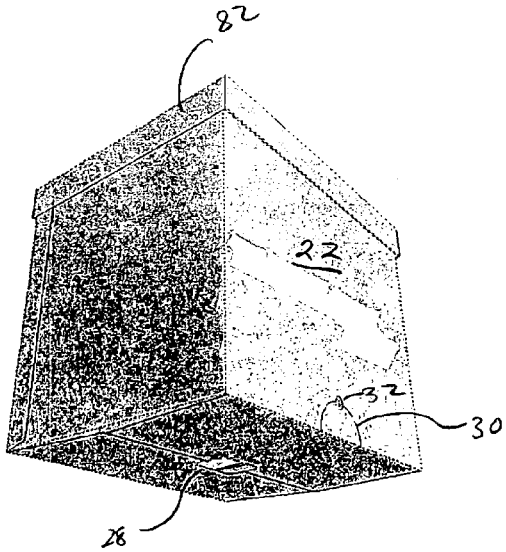
FIG. 11 is a perspective view of a container formed in accordance with the present invention.

FIGS. 10 and 11 illustrate an aspect of the present invention. More specifically, an optional top 80 for the container 90 is disclosed. Where vertical stacking or otherwise a "sealing" of the top portion of the container While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A containerboard container cut and scored to form a container comprising:

an outer housing having opposing side and end walls;

bottom panels forming a bottom wall, the bottom panels being hingedly attached to the opposing side and end walls, the bottom panels defining a hopper bore therethrough;

an inner housing having an interior upper region, at least a portion of the interior upper region being substantially rigidly attached to an inner surface of the outer housing;

an interior lower region configured to form a plurality of inwardly angled interior panels angled substantially in the direction of the hopper bore; and a removable closure panel configured to cover the hopper bore.

2. The container of claim 1, wherein the container board container is constructed from triple wall corrugated containerboard material.

3. The container of claim 1, wherein the container board container is constructed from single wall corrugated containerboard material.

4. The container of claim 1, wherein the interior upper region of the interior panel is laminated to the interior surface of the outer housing.

5. The container of claim 1, further comprising a binder attached the angled interior panels, said binder helping to hold the angled interior panels in place.

6. The container of claim 5, wherein the binder is at least one of a tape or adhesive strip.

* * * * *